US008132873B2

(12) United States Patent
Yang

(10) Patent No.: US 8,132,873 B2
(45) Date of Patent: Mar. 13, 2012

(54) RAIL ASSEMBLY

(76) Inventor: Jui-Lien Yang, Taipei County (TW)

( * ) Notice: Subject to any disclaimer, the term of this patent is extended or adjusted under 35 U.S.C. 154(b) by 332 days.

(21) Appl. No.: 12/419,280

(22) Filed: Apr. 6, 2009

(65) Prior Publication Data

US 2009/0189499 A1 Jul. 30, 2009

Related U.S. Application Data

(63) Continuation-in-part of application No. 11/905,638, filed on Oct. 3, 2007, now Pat. No. 7,588,299.

(51) Int. Cl.
*A47B 88/04* (2006.01)

(52) U.S. Cl. ..... 312/333; 312/334.47

(58) Field of Classification Search ..... 312/333, 312/334.44, 334.46, 334.47, 334.6, 334.14, 312/34.25, 334.27, 334.34; 384/21
See application file for complete search history.

(56) References Cited

U.S. PATENT DOCUMENTS

| | | | | |
|---|---|---|---|---|
| 6,652,050 | B2 * | 11/2003 | Lin | 312/333 |
| 6,979,066 | B2 * | 12/2005 | Yang | 312/333 |
| 2004/0227438 | A1 * | 11/2004 | Tseng et al. | 312/333 |
| 2007/0001562 | A1 * | 1/2007 | Park | 312/333 |

* cited by examiner

*Primary Examiner* — Hanh V Tran

(57) ABSTRACT

A rail assembly includes an outer rail, a middle rail, an inner rail, and a retrieving unit. The middle rail has a receiving space defined in an underside thereof, such that a length and a moving range of the middle rail are increased. A guiding member is disposed in the inner rail and temporarily engages with a clip to connect the inner rail and a moving part. At least one spring is disposed between a fixing part and the moving part. Two receiving slots are respectively disposed between the fixing part and the moving part with the outer rail, such that the inner rail spans across the receiving slots to reach the closed end of the outer rail space for increasing an overall spread length of the rail assembly.

6 Claims, 20 Drawing Sheets

RAIL ASSEMBLY

CROSS-REFERENCE TO RELATED APPLICATION

This application is a Continuation-in-part Application of Ser. No. 11/905,638, filed 3 Oct. 2007, and entitled "RAIL ASSEMBLY FOR DRAWERS", now pending.

BACKGROUND OF THE INVENTION

1. Field of the Invention

The present invention relates to a rail assembly, and more particularly to a rail assembly for drawers.

2. Description of Related Art

A conventional rail assembly is widely used on drawers and generally includes an outer rail, an inner rail and an intermediate rail disposed between the outer rail and the inner rail. The outer rail is fixed to the desk. The inner rail is connected to the side of the drawer. Multiple steel balls are disposed between the intermediate rail and the inner rail such that the drawer pulls out or pushes in easily.

The conventional rail assembly further has a retrieving unit disposed on the bottom of the outer rail to provide an effort of automatic retraction for pushing the intermediate rail and the inner rail in the outer rail. However, the retrieving unit occupies the space of the outer rail. The length of the inner rail and that of the intermediate rail are shorter than that of the outer rail, otherwise the inner rail and the intermediate rail are not completely received in the outer rail. Therefore, the total travel (span) when the outer rail, the intermediate rail and the inner rail expand completely is less the ideal length (span), which is the triple length of the outer rail. If the actual travel (span) approaches to the ideal length (span), the pan ratio is good. Therefore, the short rail assembly has great expanding effort. The intermediate rail and the inner rail are not required to be shortened their length such that the strength of the intermediate rail and the inner rail are not affected. The conventional intermediate rail is cut for receiving a damping mechanism. The conventional rail assembly has a good travel (span) but a poor strength.

A conventional rail assembly in accordance with the prior art shown in FIG. 1 comprises an outer rail 90, an intermediate rail 91, an inner rail 92, a sliding rail 93, and a damper 94. The outer rail 90 has a U cut-shaped section. The outer rail 90 has a stopper 901 and a fixing base 902 disposed in a free end thereof. A sliding space 903 is defined between the outer rail 90 and the stopper 901 and the fixing base 902. The intermediate rail 91 has an opening 910 defined in one end thereof to prevent from interference with the sliding rail 93. The inner rail 92 is received in the sliding space 903 and movably slides relative to the outer rail 90. The inner rail 92 has a clasper 920 disposed in one end thereof and corresponding to the fixing base 902. The sliding rail 93 is fixed to the fixing base 902 and received in the sliding space 903 between the inner rail 92 and the fixing base 902 to form a closed type rail. When the intermediate rail 91 moves toward the fixing base 902, the sliding rail 93 is received in the opening 910. The sliding rail has a positioning hook 930 disposed therein and corresponding to the clasper 920. When the positioning hook 930 engages with the clasper 920, the inner rail 920 is connected to the sliding rail 93 in a predefined distance. The positioning hook 930 is limited by the closed type sliding rail 93. The damper 94 is disposed in the fixing base 902.

The opening 910 in the intermediate rail 91 results in the loss of the length and the strength. Besides, the fixing base 902 (inner rail 92) does not have any structure for fitting the inner rail 92 (opening 910). The inner rail 92 can not extend or retract efficiently. Therefore, the conventional rail assembly has the problem of poor span.

In other aspect, the damper 94 of the conventional rail assembly is disposed in the end of the outer rail 90. The damper 90 has an air chamber and a pushing rod. The pushing rod pushes the air chamber to create the effort of damping. The pushing rod occupies the space of the outer rail 90. When the inner rail 92 automatically retracts, the inner rail 92 abuts against the damper 94 to damp the inner rail 92. Therefore, the length of the inner rail 92 is limited such that the total travel (span) of the rail assembly is limited.

Furthermore, the adaptability between the retrieving unit and the outer rail is another problem. The conventional retrieving unit is used the inner wall of the outer rail as a rail. Therefore, the width of the retrieving unit is equal to that of the inner rail. For the outer rails with different sizes, the different retrieving units are required to fit the outer rails. This is not convenient for warehousing.

The present invention has arisen to mitigate and/or obviate the disadvantages of the conventional rail assembly.

SUMMARY OF THE INVENTION

The main objective present invention is to provide an improved rail assembly which provides a steady structure, a good span ratio, and adaptability for different sizes.

To achieve the objective, the rail assembly includes an outer rail, a middle rail, an inner rail, and a retrieving unit. The outer rail has an outer rail space defined therein for receiving the middle rail, the inner rail, and the retrieving unit. The middle rail is movably received in the outer rail space. The middle rail has a middle rail space defined therein. The inner rail is movably received in the middle rail space. The retrieving unit is disposed in one end of the outer rail space. The retrieving unit comprises a fixing part, a sliding rail, a moving part, a clip, a guiding member, and at least one spring. The fixing part is disposed in the outer rail space, such that one end of the outer rail space is made into a closed end. The sliding rail is disposed in one free-end (surface) of the fixing part. The moving part is disposed in the outer rail space. The moving part moves along the sliding rail and is movably received in the outer rail space. The middle rail has a receiving space defined in an underside thereof such that a length and a moving range of the middle rail are increased. The clip is pivotally connected to the moving part. The guiding member is disposed in the inner rail. The guiding member temporarily engages with the clip to connect the inner rail and the moving part. The at least one spring is disposed between the fixing part and the moving part. Two receiving slots in the outer rail space are respectively disposed on two sides of the fixing part and the moving part. When the inner rail moves in the outer rail space, the inner rail spans across the receiving slots to reach the closed end of the outer rail, such that a length of the inner rail is equal to that of the outer rail.

Further benefits and advantages of the present invention will become apparent after a careful reading of the detailed description with appropriate reference to the accompanying drawings.

DETAILED DESCRIPTION OF THE INVENTION

Figure 1:
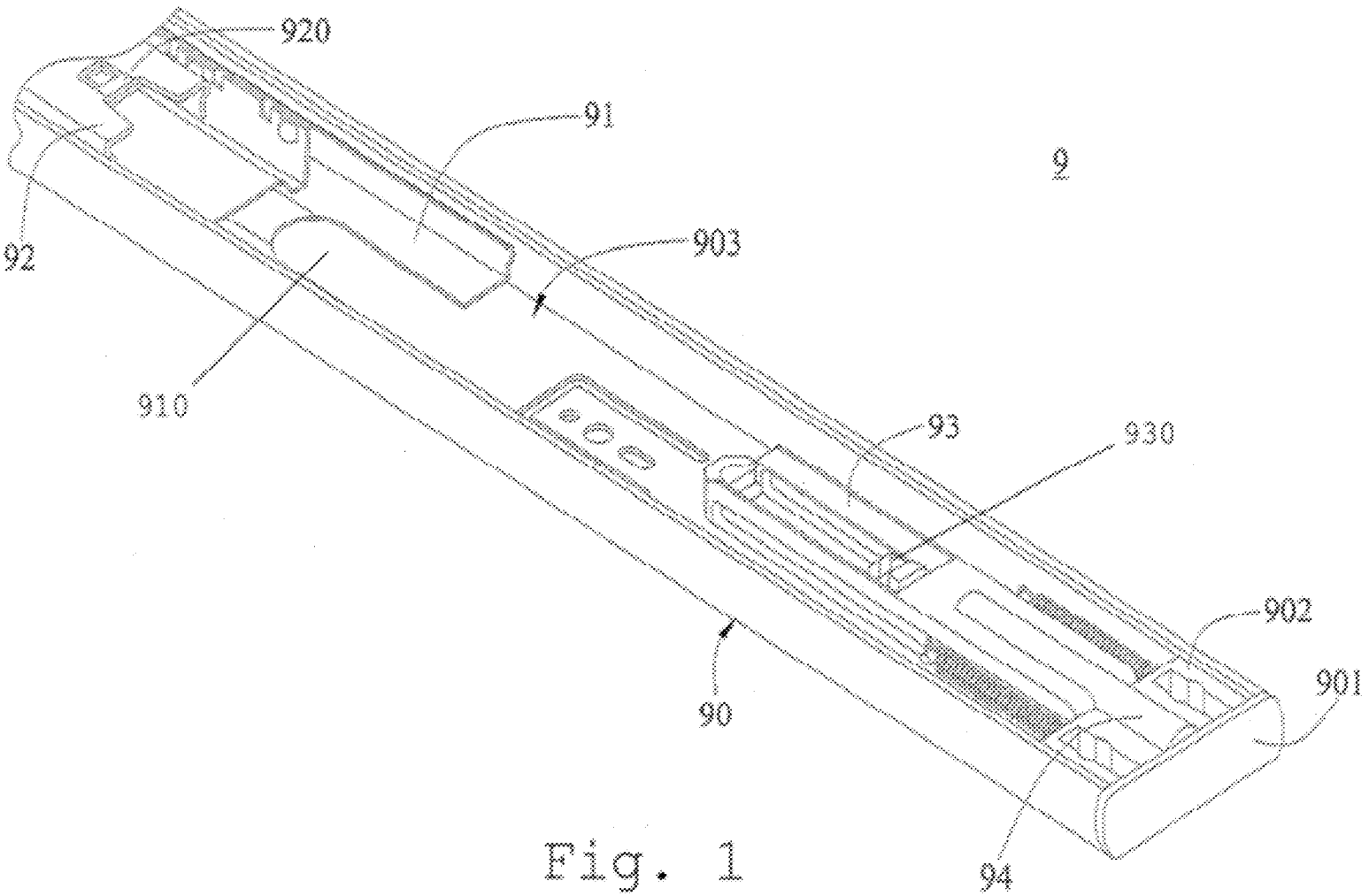
Fig. 1 PRIOR ART
FIG. 1 is a perspective view of a rail assembly in accordance with the prior art.
Figure 2:
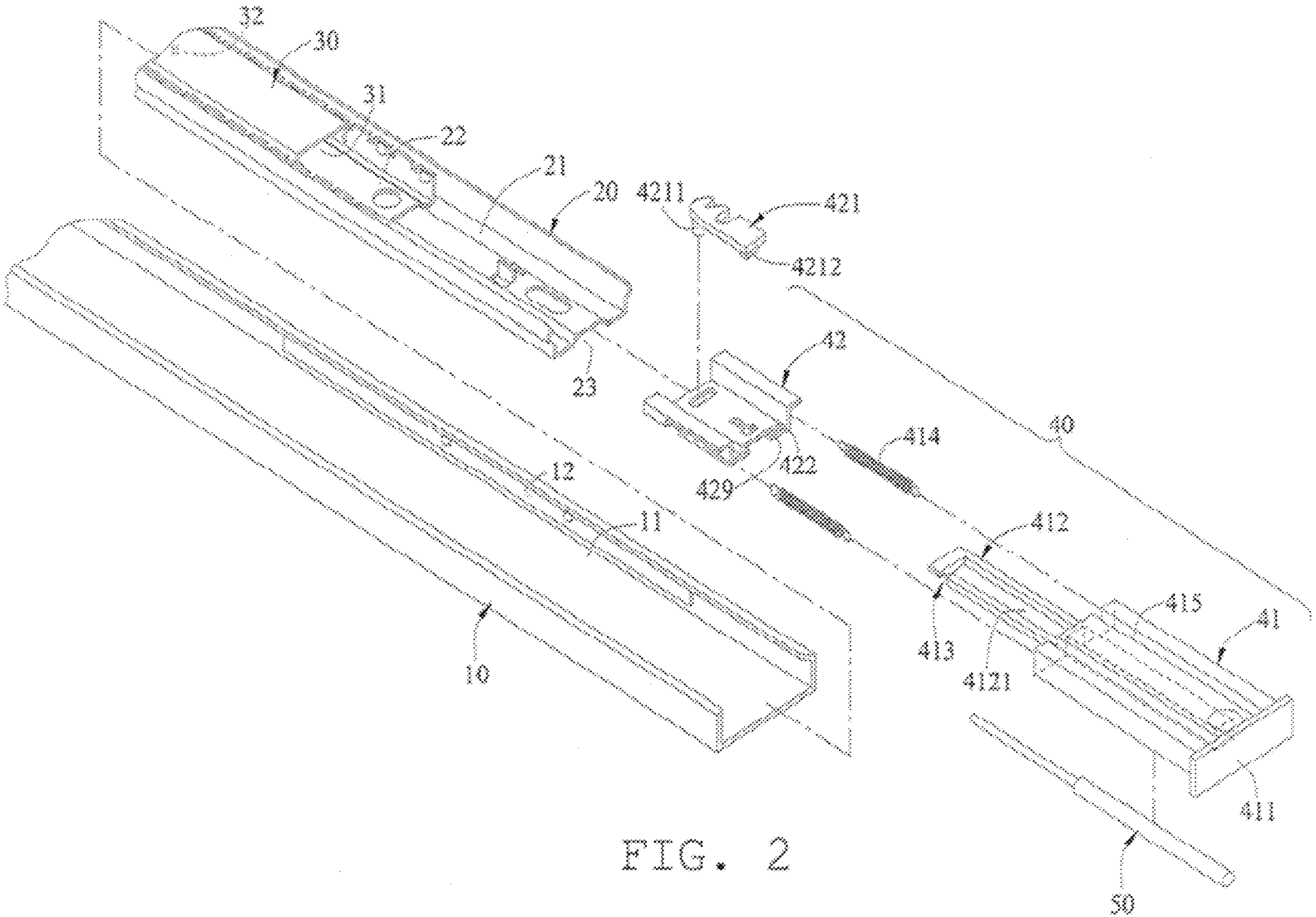
FIG. 2 is an exploded perspective view of a first embodiment of a rail assembly in accordance with the present invention.
Figure 3:
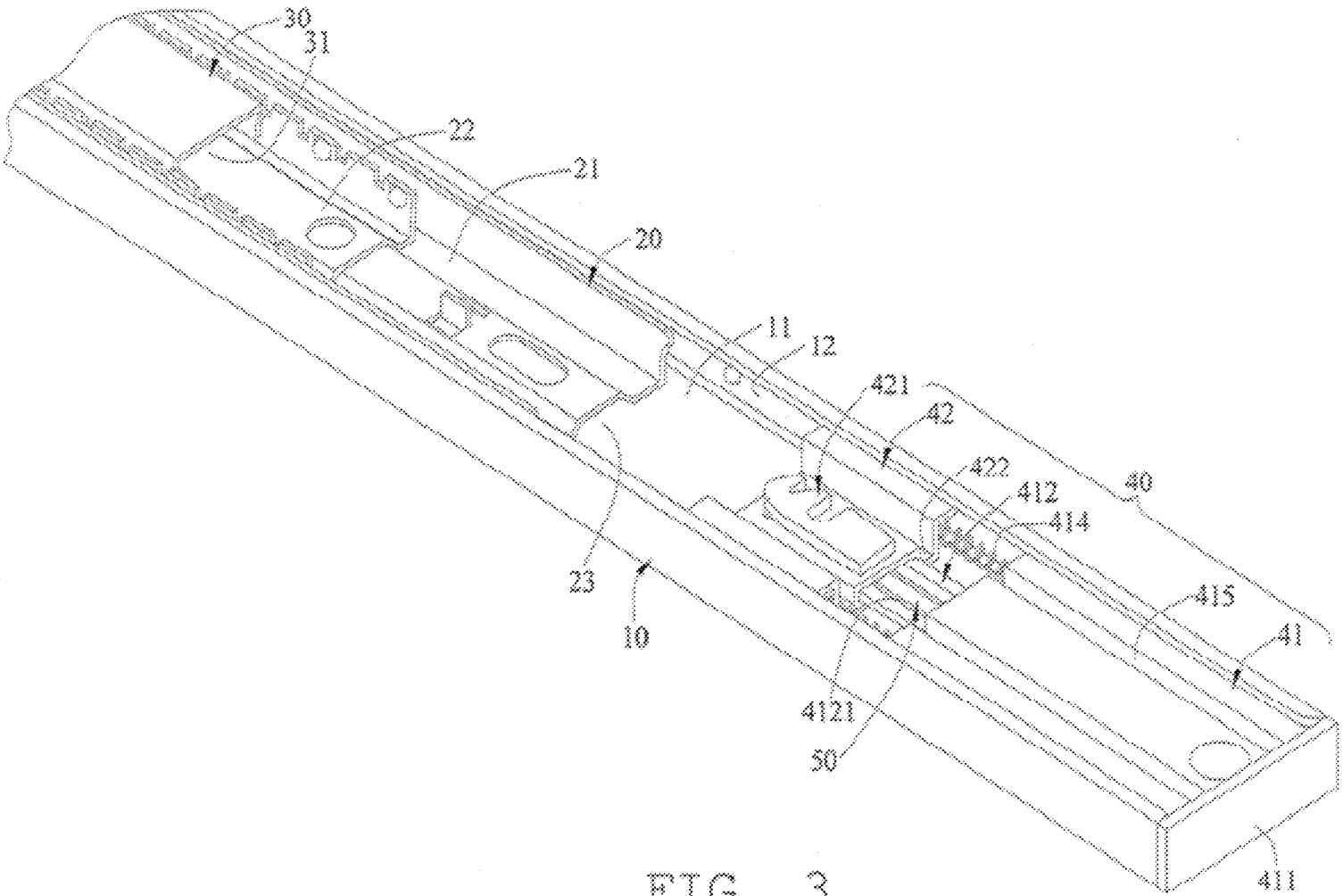
FIG. 3 is an assembled perspective view of the first embodiment of the rail assembly in accordance with the present invention.

Referring to the drawings and initially to FIGS. 2-3, a first embodiment of a rail assembly in accordance with the present invention comprises an outer rail 10, a middle rail 20, an inner rail 30, a retrieving unit 40, and a damper 50.

The outer rail 10 has a U-shaped section. The outer rail 10 has an outer rail space 11 defined therein for receiving the middle rail 20, the inner rail 30, and the retrieving unit 40. A roller assembly 12 is disposed in the outer rail space 11 such that the middle rail 20 is movably connected to the outer rail 10.

The middle rail 20 also has a U-shaped section. The width of the middle rail 20 is slightly smaller than that of the roller assembly 12. The middle rail 20 is received in the roller assembly 12 to movably connect to the outer rail 10. The middle rail 20 is movably received in the outer rail space 11. The middle rail 20 has a middle rail space 21 defined therein. A roller assembly 22 is disposed in the middle rail space 21 such that the inner rail 30 is movably connected to the middle rail 20. The middle rail 20 has a receiving space 23 defined in an underside thereof.

The inner rail 30 has a reversed U-shaped section. The inner rail 30 has an inner rail space 31 defined therein. The width of the inner rail 30 is slightly smaller than that of the roller assembly 22 in the middle rail space 21. The inner rail 30 is received in the roller assembly 22 such that the inner rail 30 is movably connected to the middle rail 20. The inner rail 30 is movably received in the middle rail space 21.

The retrieving unit 40 is disposed in one end of the outer rail 10. The retrieving unit 40 comprises a fixing part, a sliding rail 412, two springs 414, a moving part 42, and a guiding member 32. The fixing part 41 is fixed in the outer rail space 11. The fixing part 41 has a stop flange 411 formed in one end thereof to close the outer rail space 11. The sliding rail 412 is extended from the other end of the fixing part 41. In this embodiment the sliding rail 412 is connected to the fixing part 41. In other embodiment the sliding rail 412 is formed in the outer rail 10 and near the fixing part 41. The two springs 414 are respectively disposed in two laterals of the fixing part 41. Each spring 414 is connected to the moving part 42 to provide the moving part 42 retracted by the resilient force.

The sliding rail 412 is provided for assembling with the moving part 42, such that the moving part 42 moves along the sliding rail 412. The sliding rail 412 has a lean rail 4121 formed therein. The lean rail 4121 has a hold slot 413 defined in a front end thereof. The hold slot 413 is provided for temporarily fastening the moving part 42 with the sliding rail 412. A width of the sliding rail 412 is smaller than that of the receiving space 23 in the middle rail 20. The sliding rail 412 is corresponded to the receiving space 23, such that the middle rail 20 moves free in the outer rail space 11 and is not blocked by the sliding rail 412.

Through the structure of the open-type sliding rail 412, the moving part 42 is enabled to slide in the free-end of the outer rail space 11, so as to increase the retracting stroke of the moving part 42 and increase the sliding scope of the middle rail 20, thereby increasing the length of the middle rail 20 and the overall spread length of the rail assembly.

Figure 6:
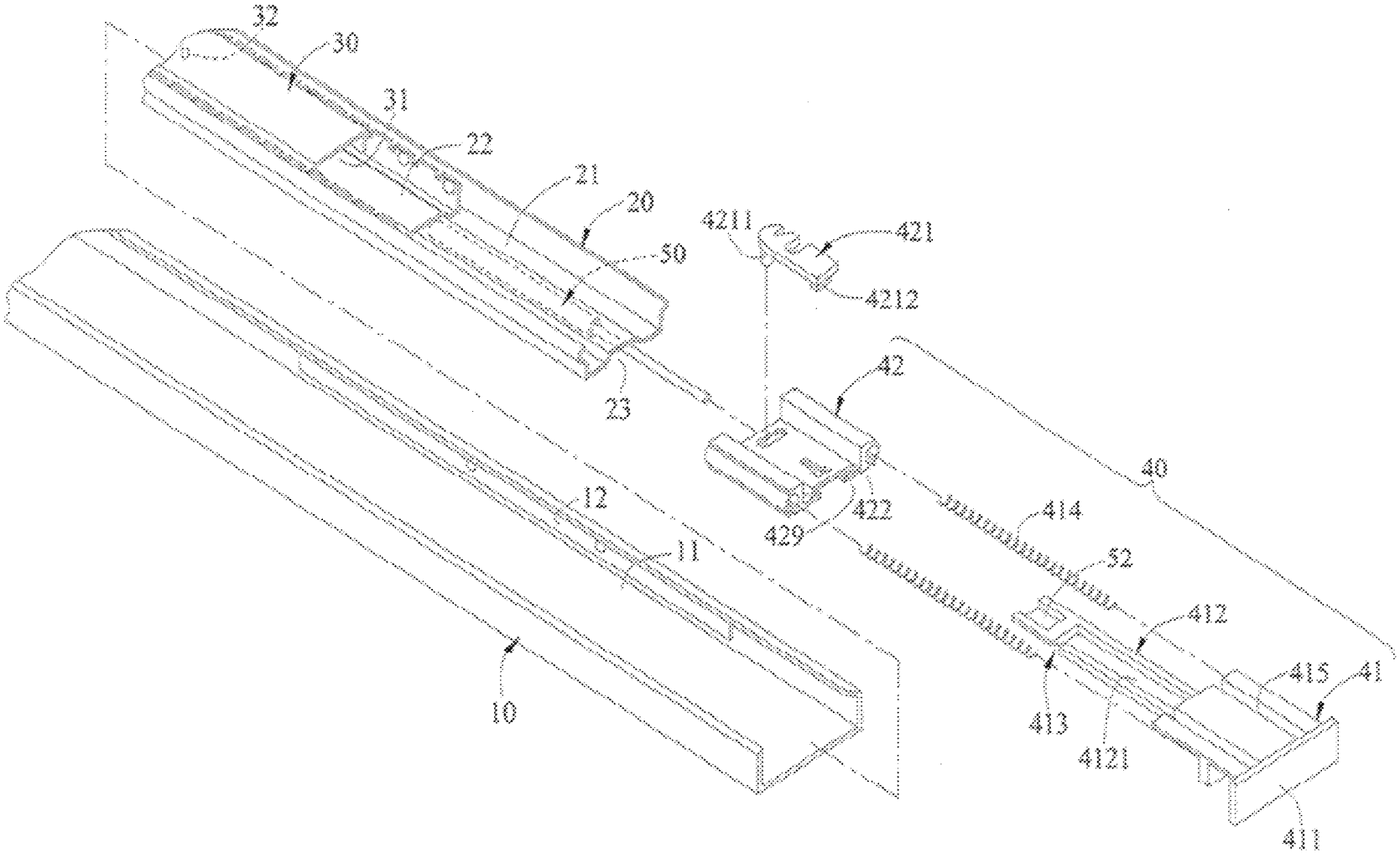
FIG. 6 is an exploded perspective view of a second embodiment of a rail assembly in accordance with the present invention.

Referring to FIGS. 2-3, the moving part 42 has a clip 421 disposed therein. The clip 421 is pivotally connected to the moving part 42. The clip 421 has a first (clipping) projection 4211 and a second (stable) projection 4212 respectively formed in an underside thereof. The guiding member 32 is disposed in an inner side of the inner rail 30. The guiding member 32 is a projection structure and is selectively operated be engaged with the clip 421. Referring to FIG. 6, when the inner rail 30 overlaps with the moving part 42, the guiding member 32 engages with the clip 421, such that the inner rail 30 is connected to the moving part 42 temporarily. The first (clipping) projection 4211 and the second (stable) projection 4212 are engaged with the lean rail 4121, so as to enhance the stability.

When the moving part 42 is pulled outwardly, the first (clipping) projection 4211 slides into the hold slot 413, such that the moving part 42 is fastened in the front end of the sliding rail 412. The inner rail 30 is separated from the clip 421 and is pulled out. On the contrary, when the inner rail 30 is pushed inwardly, the guiding member 32 engages with the clip 421, and the first (clipping) projection 4211 slides out of the hold slot 413 such that the inner rail 30 is connected to the moving part 42 to retract. Two receiving slots 422 and 415 in the outer rail space 11 are respectively disposed on two sides of the moving part 42 and the fixing part 41, such that the inner rail 30 span across the receiving slots 422, 415 to reach the closed end of the outer rail space 11, and increase the overall spread length of the rail assembly.

Meanwhile, each spring 414 is just located on two outer sides of the receiving slots 415 and 422, so as not to obstruct the moving motion of the inner rail 30.

The damper 50 is fixed on one end of the outer rail 10. In this embodiment, referring to FIG. 2, the damper 50 is a pressure bar. One end of the damper 50 is fixed 4 on the fixing part 41. The other end of the damper 50 is abutted against the moving part 42, so as to provide the damping effect for the moving part 42. The damper 50 can be any other damping member with different damping coefficient.

Figure 4:
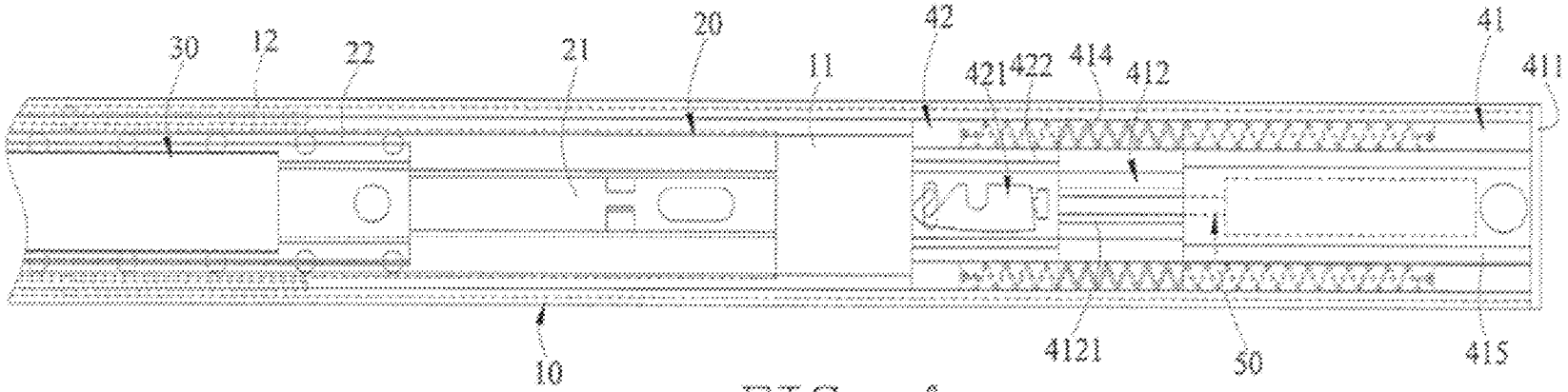
FIGS. 4 and 5 show the operation of the first embodiment of the rail assembly in accordance with the present invention.
Figure 5:
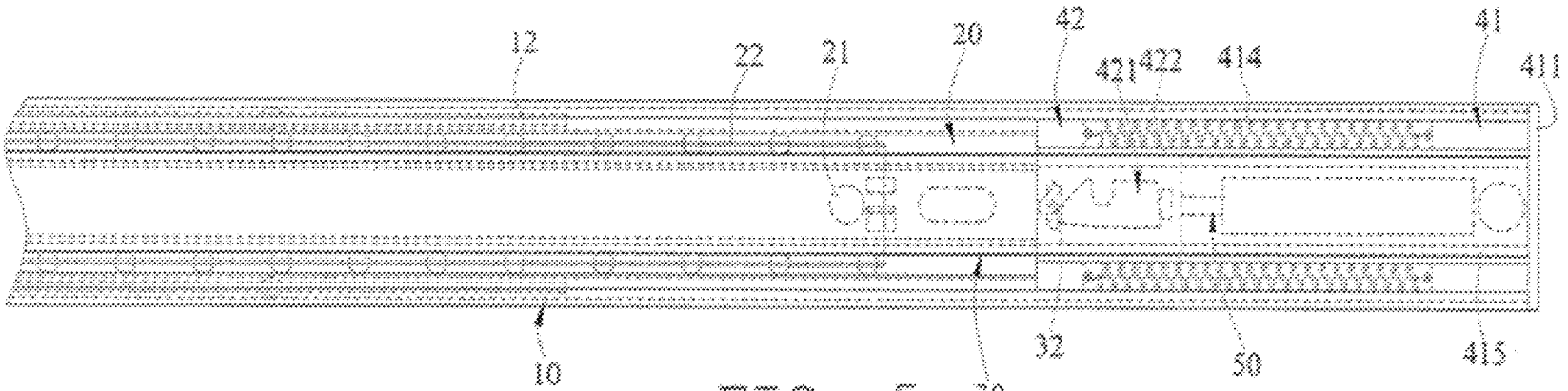

Referring to FIGS. 4-5, when the middle rail 20 and the inner rail 30 are received in the outer rail space 11, the receiving space 23 in the middle rail 20 corresponds to the sliding rail 412, such that the middle rail 20 is not blocked by the sliding rail 412. The middle rail 20 effectively extends closely into the end of the outer rail 10, and the inner rail 30 successfully extends into the end of the outer rail 10 through the receiving slots 415,422. The inner rail 30 is temporarily connected to the moving part 42 by the engagement of the guiding member 32 and the clip 421. When the inner rail 30 is pulled outwardly, the moving part 42 is driven to move along the sliding rail 412. The moving part 42 moves with the clip 421 and then slides into the hold slot 413. Therefore, the moving part 42 is fastened with the sliding rail 412 temporarily. In the present invention, both middle rail 20 and the inner rail 30 can be effectively extend to a position close to the end of the outer rail 10. Therefore, the middle rail 20 and the inner rail 30 may have longer length, so as to increase the overall spread length of the rail assembly, thereby improving the retracting and the extending ratio.

Referring to FIGS. 4-5, when the middle rail 20 and the inner rail 30 are retracted, the middle rail 20 firstly abuts against the moving part 42 of the retrieving unit 40. Then, when the inner rail 30 overlaps the moving part 42, the guiding member 32 engages with the clip 421, such that the inner rail 30 is connected to the moving part 42 temporarily. The moving part 42 is driven to slides out the hold slot 413 by the movement of the inner rail 30. When the moving part 42 slides out the hold slot 413, the moving part 42 is retracted toward the end of the outer rail space 11 by the spring 414. In the meantime, the damper 50 provides the function of slowing down. Therefore, the moving part 42 and the inner rail 30 gently move toward the end of the inner rail 10 to prevent the great impact. The inner rail 30 and the intermediate middle rail 20 move with the moving part 41 to the end of the outer rail space 11 in a retracting state as shown in FIG. 4.

Referring to FIG. 6, a second embodiment of a rail assembly in accordance with the present invention is illustrated. In the following, only the differences there-between the first embodiment and the second embodiment are described. The rail assembly has a damper unit. The damper unit includes a damper 50 and a stopper 52 (not shown). The damper 50 is disposed in the avoiding receiving space 23 at the bottom of the middle rail 20. The stopper 52 is disposed in a front end of the sliding rail 412 and corresponding to the damper 50. In this manner, when the inner rail 30 and the moving part 42 retract, the damper 50 is blocked by the stopper 52 to provide the function of damping. In addition, the damper may also be disposed between the middle rail 20 and the inner rail space 31. The stopper 52 (not shown) is disposed in the inner rail space 31.

Figure 7A:
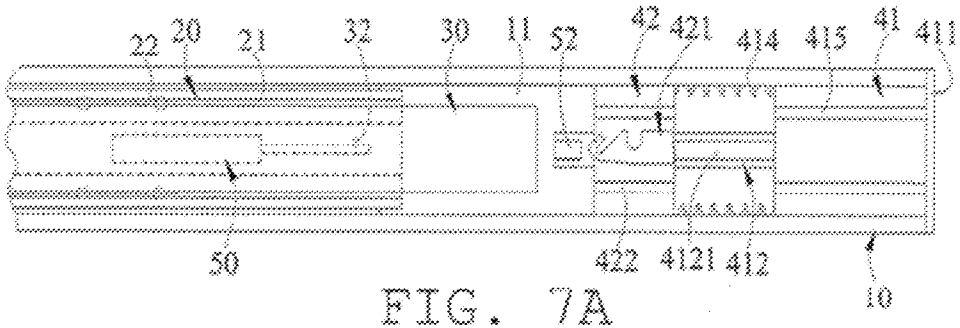
FIGS. 7A-7C show the operation of the second embodiment of the rail assembly in accordance with the present invention.
Figure 7B:
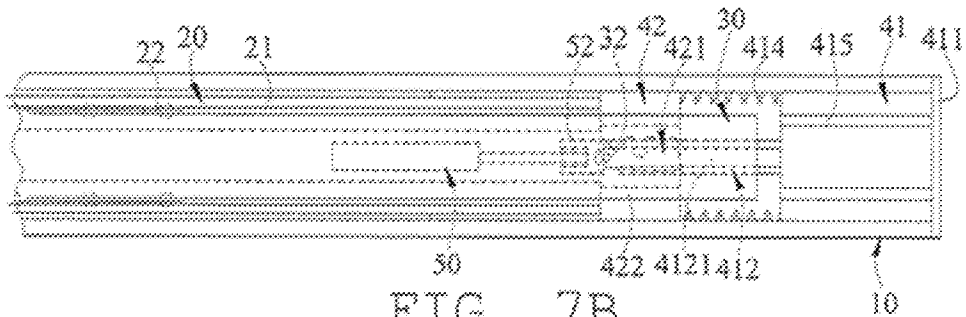
Figure 7C:
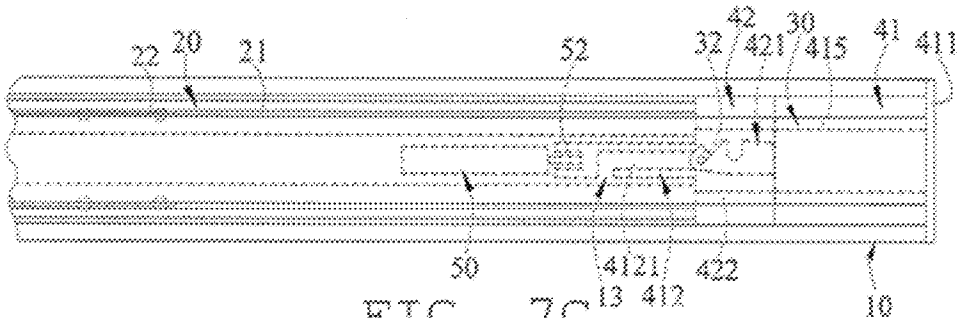

Referring to the FIGS. 7A-7C, when the inner rail 30 is pushed back, the guiding member 32 engages with the clip 421 and forces the clip 421 slides out the hold slot 413. In the meantime, the inner rail 30 and the moving part 42 are retracted by the spring 414. The damper 50 abuts against the stopper 52 to provide the damping effect.

Furthermore, the damper 50 in this embodiment is disposed in the receiving space 23 at the bottom of the middle rail 20, so that the retrieving unit 40 can appropriately reduce the length of the damper 50, so as to increase the sliding scope of the middle rail 20. Thus, a middle rail 20 with a larger length may be adopted, so that the rail assembly achieves a better overall spread length.

In the first embodiment, the moving part 42 is made of metal and the clip 421 is made of the plastic. In the second embodiment, the moving part 42 and the clip 421 are made of plastic. In the first and second embodiments, the function and features thereof of the moving parts 42 are the same.

Figure 8:
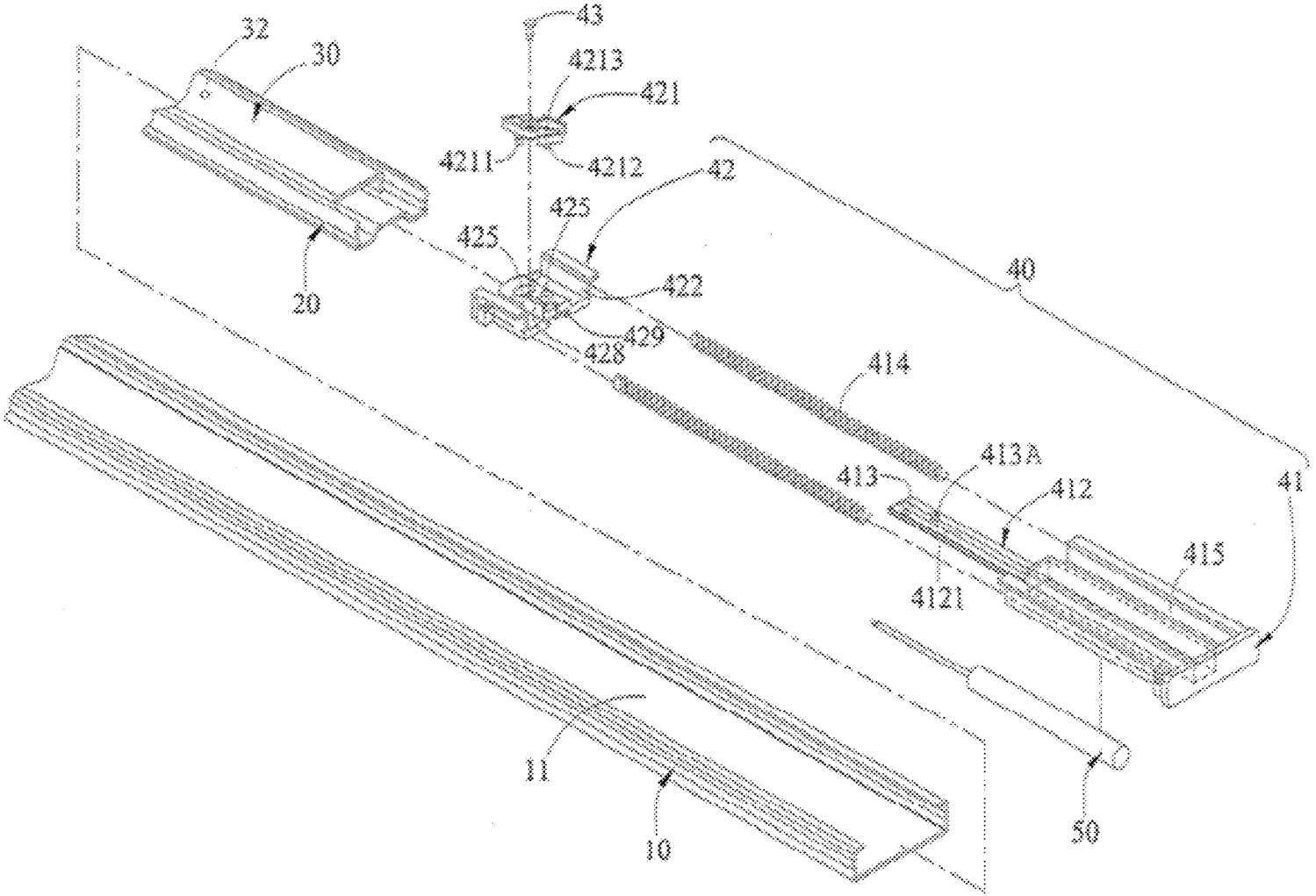
FIG. 8 is an exploded perspective view of a third embodiment of a rail assembly in accordance with the present invention.

Referring to FIG. 8, a third embodiment of a rail assembly in accordance with the present invention is illustrated. The rail assembly comprises an outer rail 10, a middle rail 20, an inner rail 30, and a retrieving unit 40. The outer rail 10 has an outer rail space 11 defined therein for receiving the middle rail 20, the inner rail 30, and the retrieving unit 40. The middle rail 20 is movably slid in the outer rail space 11, and has a middle rail space 21 defined therein for receiving the inner rail 30. A receiving space 23 is disposed at a bottom of the middle rail 20. The inner rail 30 slides in the middle rail space 21, and a guiding member 32 is disposed on the inner rail 30.

Figure 9:
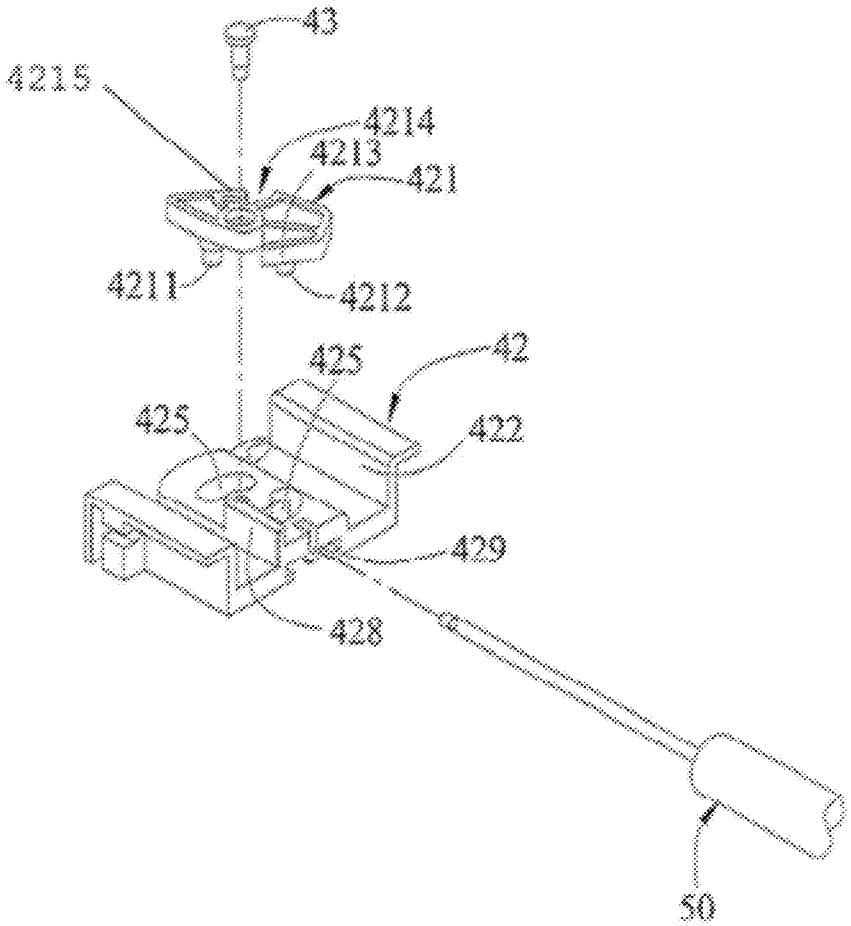
FIG. 9 is a partial enlarged perspective view of in FIG. 8.

The retrieving unit 40 includes a fixing part 41, a sliding rail 412, a moving part 42, a clip 421, and at least one spring 414. The fixing part 41 is disposed on one end of the outer rail space 11 to close one end of the outer rail space 11, The sliding rail 412 is disposed in one end of the fixing part 41. The sliding rail 412, and has a lean rail 4121 formed therein. A hold slot 413 and a slot 413A are respectively located on two sides of the lean rail 4121. The sliding rail 412 is disposed in the receiving space 23. The sliding rail 412 may be connected to the fixing part 41 together or pivoted separately from each other. In other embodiment, the sliding rail 412 is disconnected to the fixing part 41. The moving part 42 is disposed in the outer rail space 11 and moves along the sliding rail 412. The moving part 42 is disposed in the outer rail space 11 and slides along the sliding rail 412. A sliding groove 429 is disposed under the moving part 42, and is matched with the sliding rail 412, such that the moving part 42 is enabled to slide along the sliding rail 412. The clip 421 is pivoted to the moving part 42, and a connecting pin 43 is adopted to passes through the clip 421 and fastens with the moving part 42, such that the clip 421 is pivoted to the moving part 42. The clip 421 has a first (clipping) projection 4211 and a second (stable) projection 212. Two (clipping) projection 4211 and 4212, which pass through the moving part 42 and abut against the lean rail 4121. Meanwhile, a jointer 4214 is disposed on the clip 421 (as shown in FIG. 9). The spring 414 is disposed between the fixing part 41 and the moving part 42 to provide a resilient force.

The inner rail 30 has a guiding member 32 corresponding to the jointer 4214. When the inner rail 30 is pulled outwardly, the guiding member 32 engages with the jointer 214 so as to drive the clip 421 and the moving part 42 to slide along the lean rail 4121. In the meantime, the middle rail 20 is driven to slide in the outer rail space 11. In other embodiment, the guiding member 32 is a slot and the jointer 4214 is a projection corresponding to the slot. When the clip 421 moves in slides into the hold slot 413, the first (clipping) projection 4211 and the second (stable) projection 4212 respectively engage with the hold slot 413 and the slot 413A, such that the moving part 42 is fixed on the hold slot 413. In the meantime, the guiding member 32 be released from the jointer 4214 and slide outwards.

The sliding rail 412 is disposed in the receiving space 23 at the bottom of the middle rail 20, such that the middle rail 20 is not blocked by the sliding rail 412, when the middle rail 20 moves in the outer rail space 11. The rail assembly further comprises a damping unit. The damping unit includes a damper 50 and a stopper 52 corresponding to the damper 50.

The stopper 52 may be a contact portion of the moving part 42 or a blocking part disposed on the front end of the sliding rail 412; The damper 50 may be disposed on a fixing end of the fixing part 41 or disposed on the middle rail 20, or disposed the receiving space 23 between the middle rail and the outer rail 10, so as to generate a damping effect when retracting the rail assembly.

Through the structure of the open-type sliding rail 412, the moving part 42 is enabled to slide in a free-end of the outer rail space 11, so as to increase the retracting stroke of the moving part 42 and increase the sliding scope of the middle rail 20, thereby increasing the length of the middle rail 20 and the overall spread length of the rail assembly.

Two receiving slots 415 and 422 in the outer rail space 11 are respectively disposed on two sides of the fixing part 41 and the moving part 42, such that the inner rail 30 can extended into the receiving slots 422, 415 to reach the closed end of the outer rail space 11, and increase the overall spread length of the rail assembly.

Referring to the FIG. 9, a resilient member 4213 is disposed in the clip 421. The moving part 42 has a stopper 428 formed therein and corresponding to the resilient member 4213. When the clip 421 disengages the hold slot 413 and rotates, the resilient member 4213 provides a stable damping effect between the clip 421 and the moving part 42. When the moving part 42 engages the hold slot 413, the resilient member 4213 provides a stable engagement between the clip 421 and the moving part 42.

Figure 10:
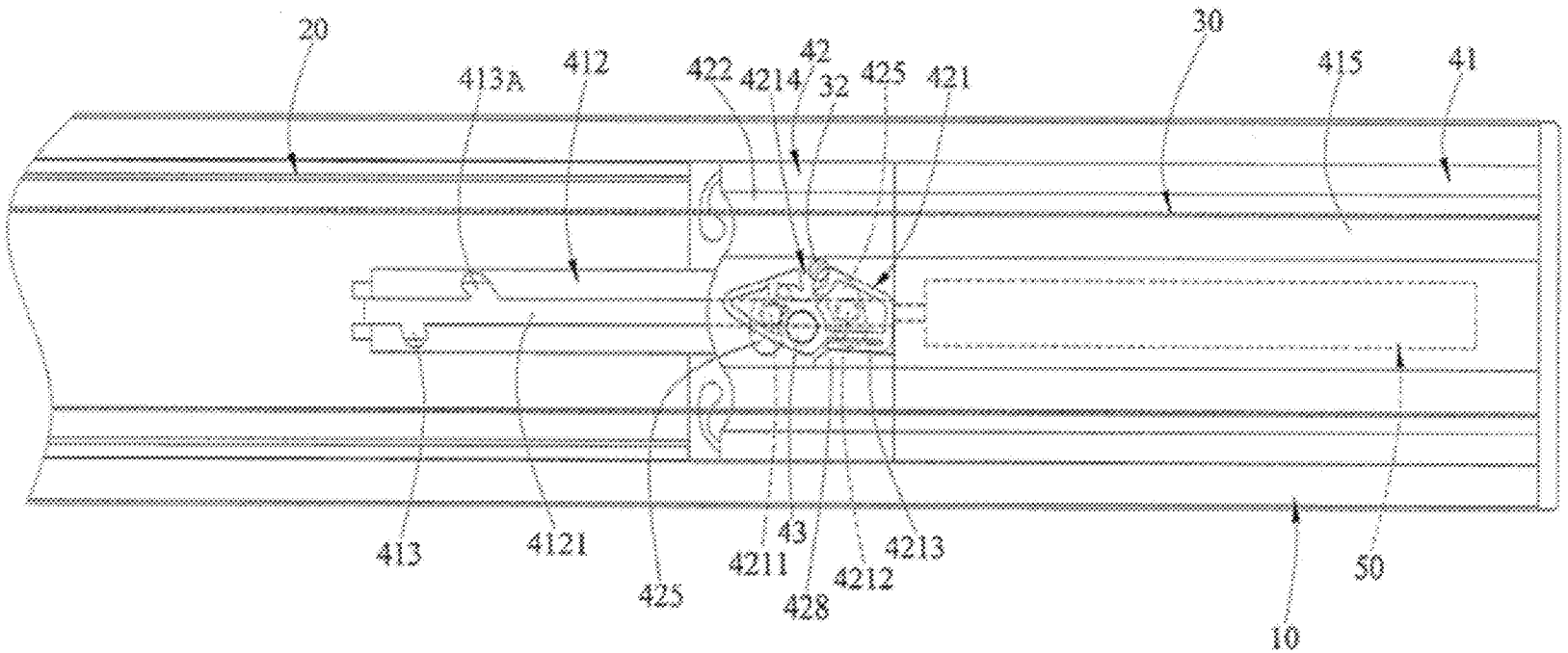
FIGS. 10-13 show the operation of the third embodiment of the rail assembly in accordance with the present invention.
Figure 11:
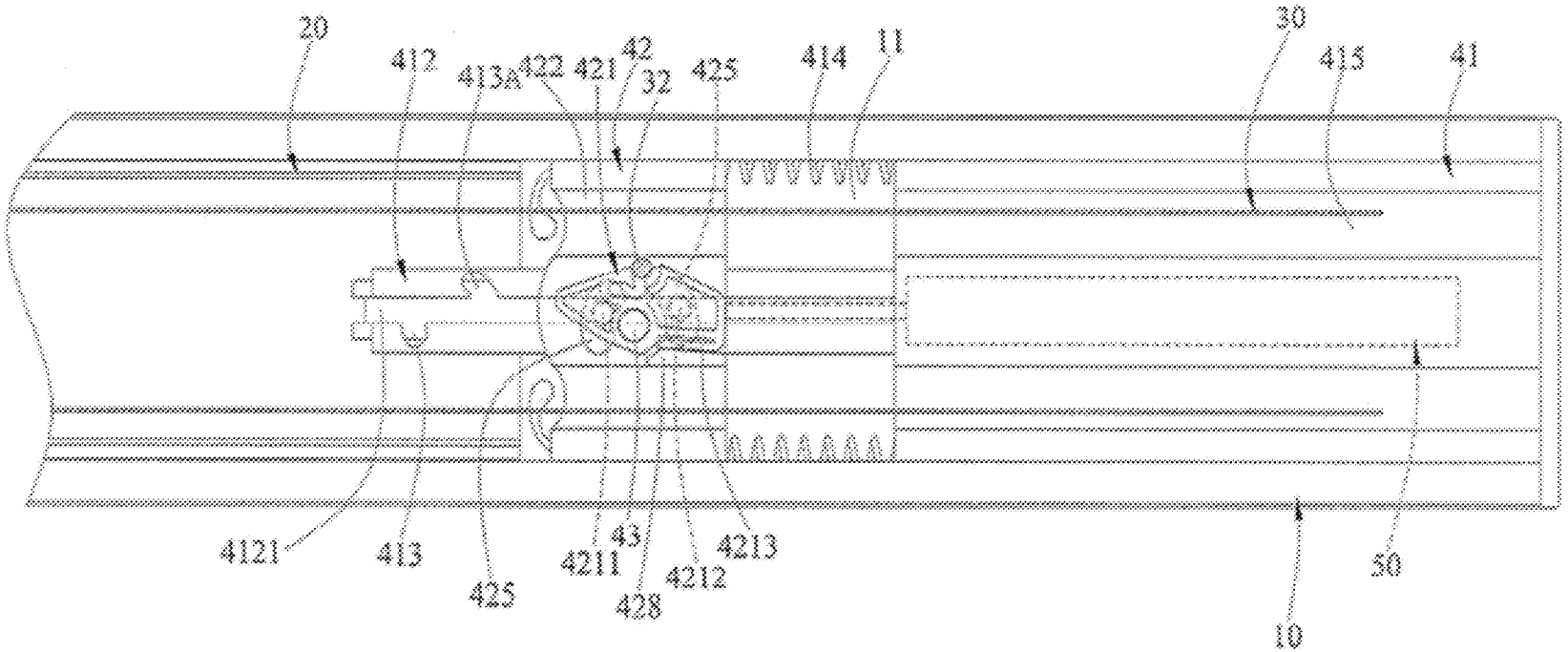
Figure 12:
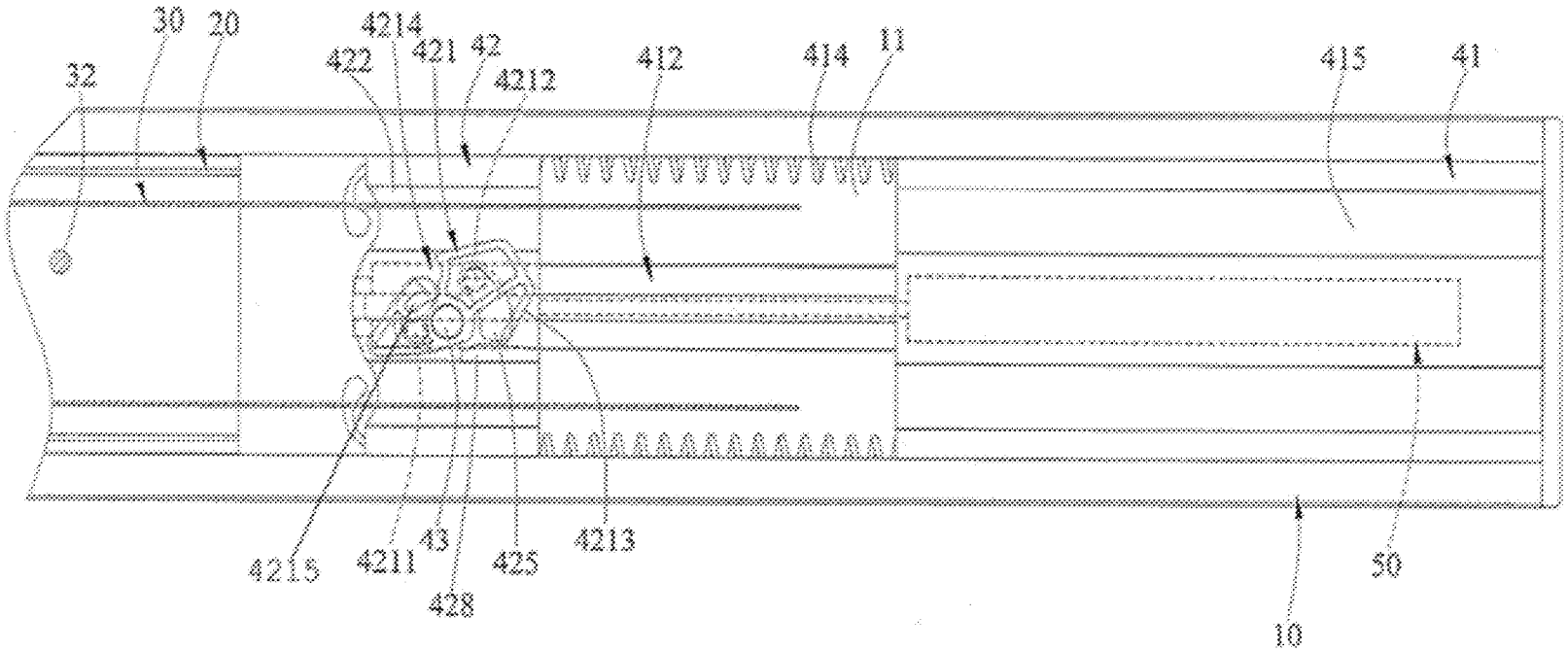

Referring to FIGS. 10-12, the operation of the third embodiment of the rail assembly in accordance with the present invention is illustrated. When the inner rail 30 is pulled outwardly and extends to free end of the sliding rail 412, the first (clipping) projection 4211 and the second (stable) projection 4212 respectively engages with the hold slot 413 and slot 413A, such that the moving part 42 is fixed on the sliding rail 412. When the inner rail 30 is pushed inwards, the guiding member 32 engages with the jointer 4214, so as to push the clip 421 to rotate with respect to the moving part 42. Accordingly, the first (clipping) projection 4211 and the second (stable) projection 4212 are separated from the hold slot 413 and the slot 413A respectively. In the meantime, the moving part 42 is subjected to the resilient force provided by the spring 414 to retract automatically. The moving part 42 and the clip 421 move inwards along the lean rail 412. In the meantime, the moving part 42 is subjected the damping effect provided by the damper 50 to slow down.

Figure 13:
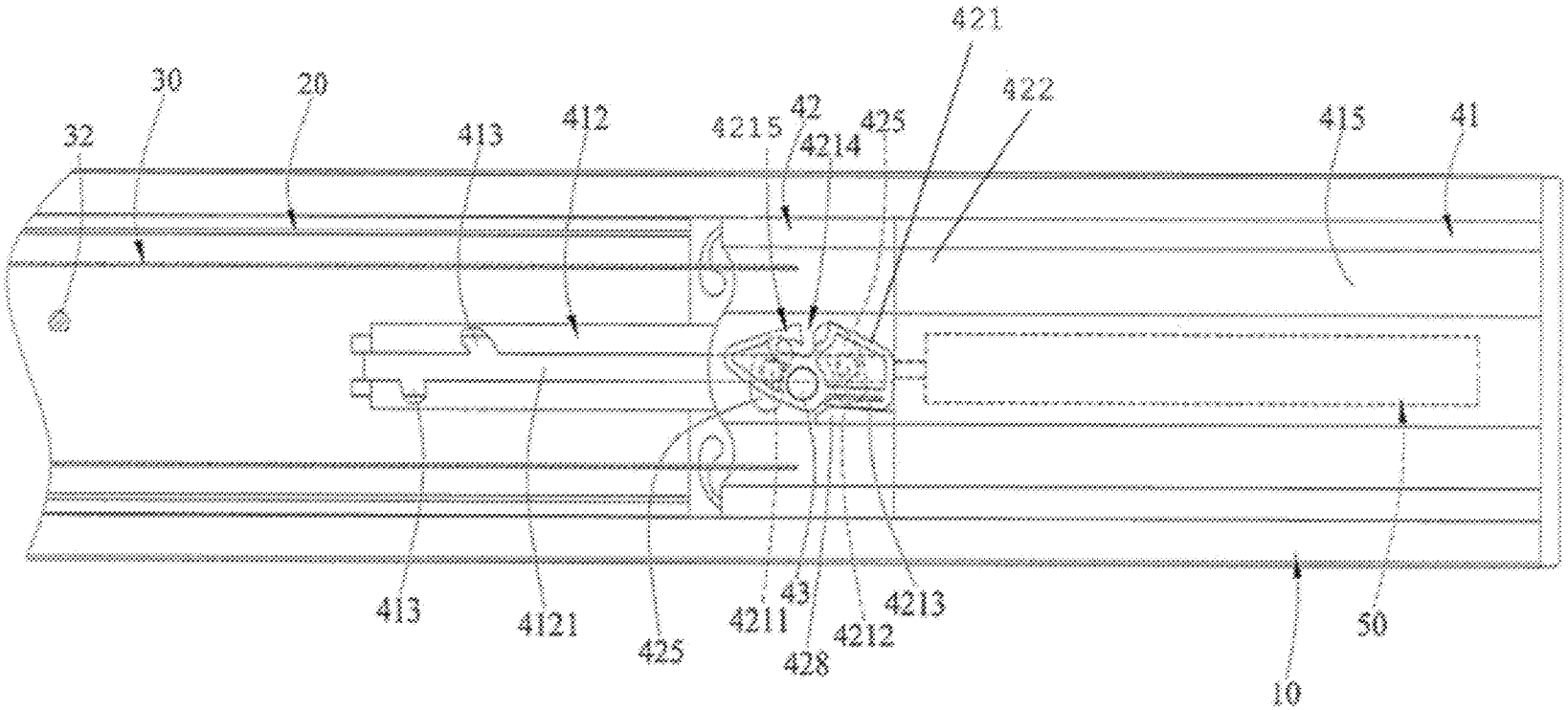

Referring to FIG. 13, a resilient groove 4215 (not shown) is disposed in a connection of the jointer 4214. When the moving part 42 disconnects to the inner rail 30 carelessly drops out and retracts automatically, user can push the inner rail 30 to retract, such that the guiding member 32 engages with the jointer 4214. The moving part 42 restores to normal clip state.

Figure 14:
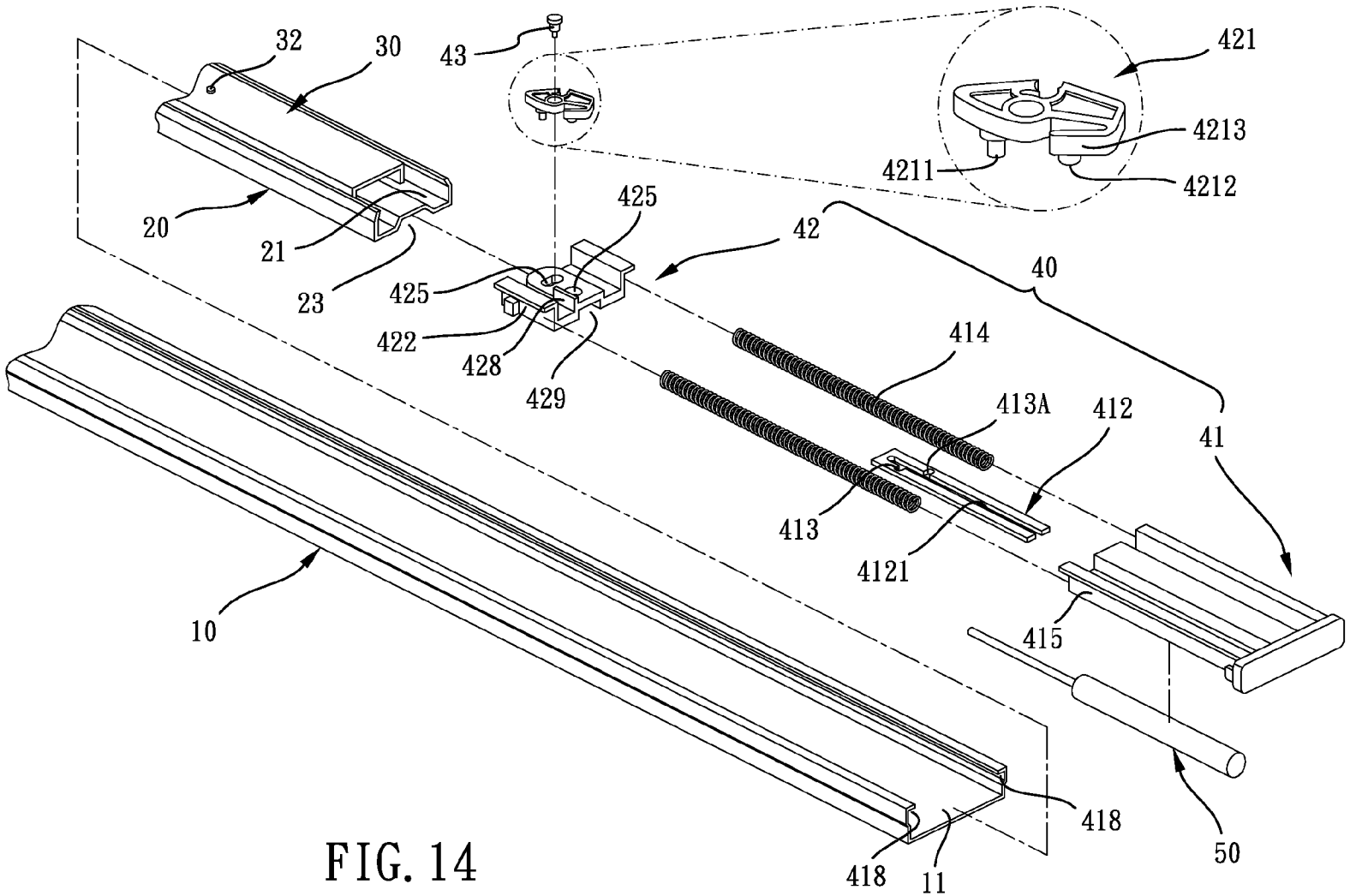
FIG. 14 is an exploded perspective view of a fourth embodiment of a rail assembly in accordance with the present invention.

Referring to FIG. 14, a fourth embodiment of a rail assembly in accordance with the present invention is illustrated. The function and features, which are the same with the third embodiment are not described repeatedly. Only the differences there-between are described below. In this embodiment, the sliding rail 418 is formed by the outer rail 10. A guiding rail 412 is separated from the fixing part 41. The moving part 42 slides along the sliding rail 418 and the guiding rail 412 in the outer rail space 11. Through the sliding rail 418, the moving part 42 may slide in a free-end of the outer rail space 11. The moving part 42 has a guiding groove 429 defined at a bottom (in an underside) thereof and corresponding to the guiding rail 412. A lean rail 4121 is disposed on the guiding rail 412. The lean rail 4121 has a hold slot 413 and a slot 413A. When the inner rail 30 is pulled outwardly, the clip 421 move along the lean rail 4121. In the meantime, the middle rail 20 moves in the outer rail space 11 so that the moving part 42 is moving between the middle rail 20 and the fixing part 41. When the clip 421 slides into the hold slot 413 and slot 413A, the moving part 42 is fixed by the clip 421. Due to the guiding rail 412 is disposed in the receiving space 23, such that the middle rail 20 is not blocked by the guiding rail 412.

Through the structure of the open-type sliding rail 418, the moving part 42 is enabled to slide in a free-end of the outer rail space 11. When the inner rail 30 is pushed inwardly, the middle rail 20 extends into the outer rail space 11 which the moving part 42 is sliding in the sliding rail 418, so as to increase the retracting stroke of the moving part 42 and increase the sliding scope of the middle rail 20, thereby increasing the length of the middle rail 20 and the overall spread length of the rail assembly. The guiding groove 429 is disposed at a bottom of the moving part 42, and is matched with the guiding rail 412.

Figure 15:
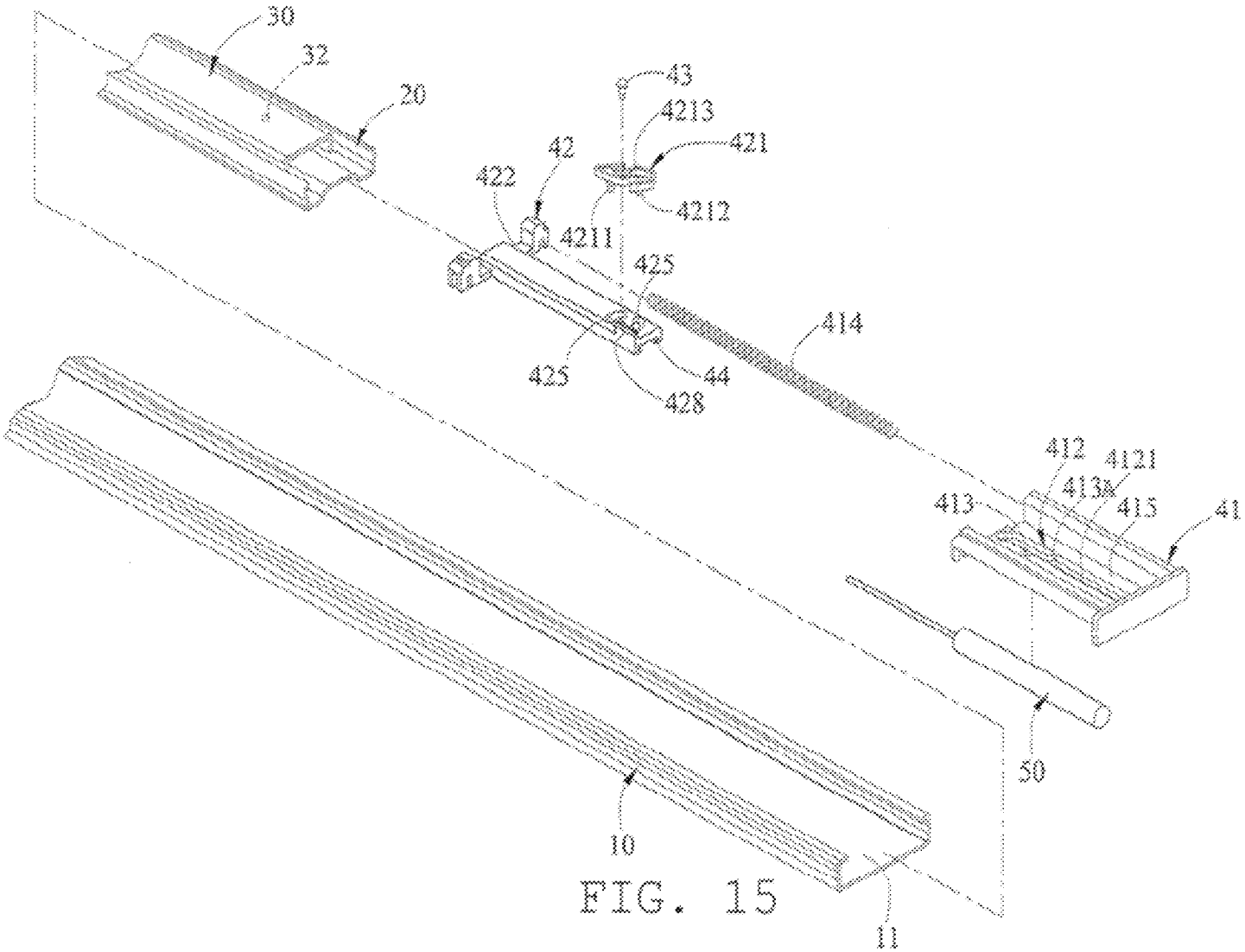
FIG. 15 is an exploded perspective view of a fifth embodiment of a rail assembly in accordance with the present invention.

Referring to FIG. 15, a fifth embodiment of a rail assembly in accordance with the present invention is illustrated. The function and features, which are the same with the third embodiment are not described repeatedly. Only the differences there-between are described below. In this embodiment, the retrieving unit 40 includes a fixing part 41, a moving part 42, a clip 421, and a spring 414. One side of the fixing part 41 has a sliding rail 412 formed therein. The moving part 42 has an extending groove 44 defined in an underside thereof and corresponding to the sliding rail 412. The moving part 42 moves in a free-end of the outer rail space 11 through the sliding rail 412.

Through the structure of the open-type sliding rail 412, the moving part 42 is enabled to slide in a free-end of the outer rail space 11, so as to increase the retracting stroke of the moving part 42 and increase the sliding scope of the middle rail 20, thereby increasing the length of the middle rail 20 and the overall spread length of the rail assembly.

Figure 16:
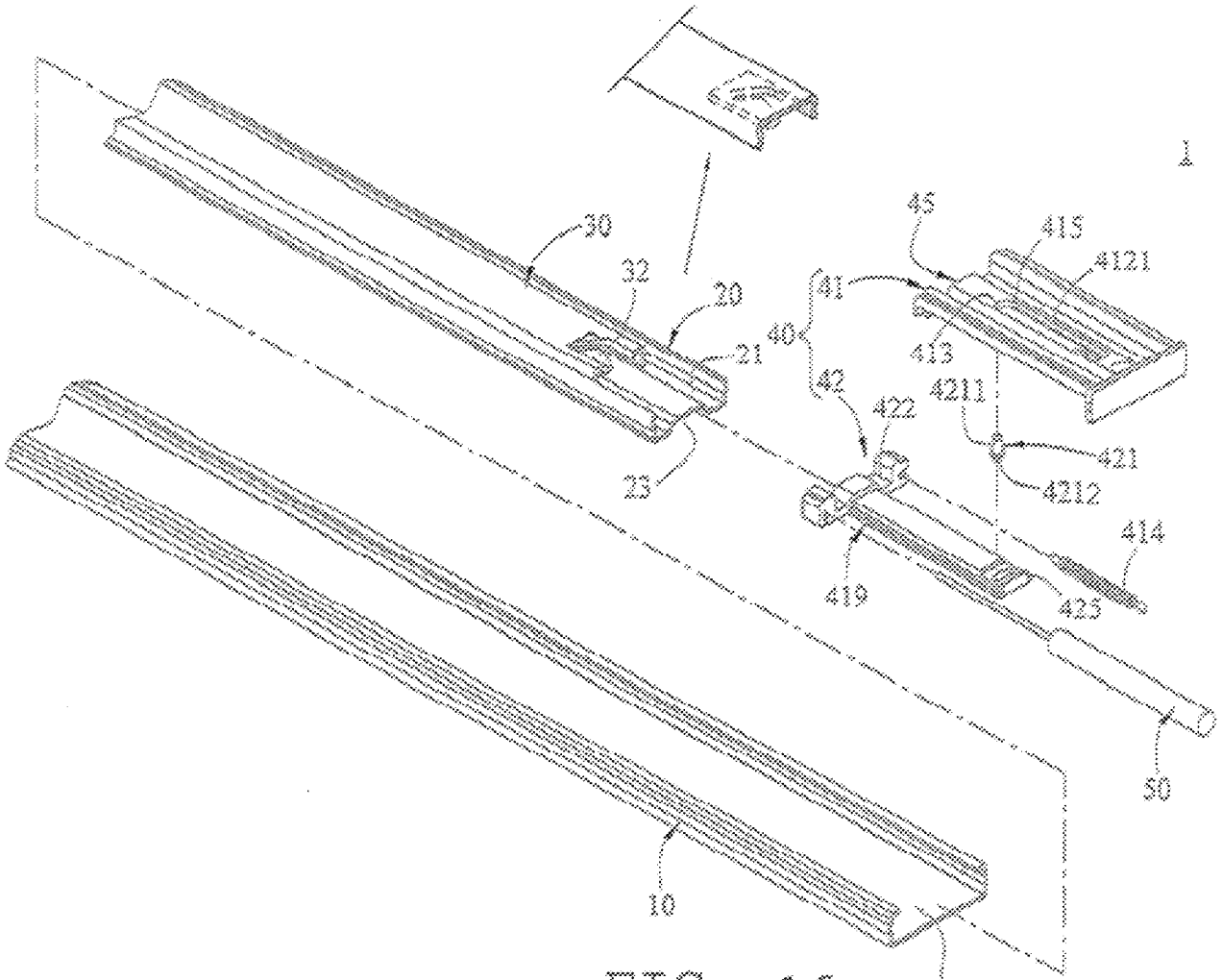
FIG. 16 is an exploded perspective view of a sixth embodiment of a rail assembly in accordance with the present invention.
Figure 17:
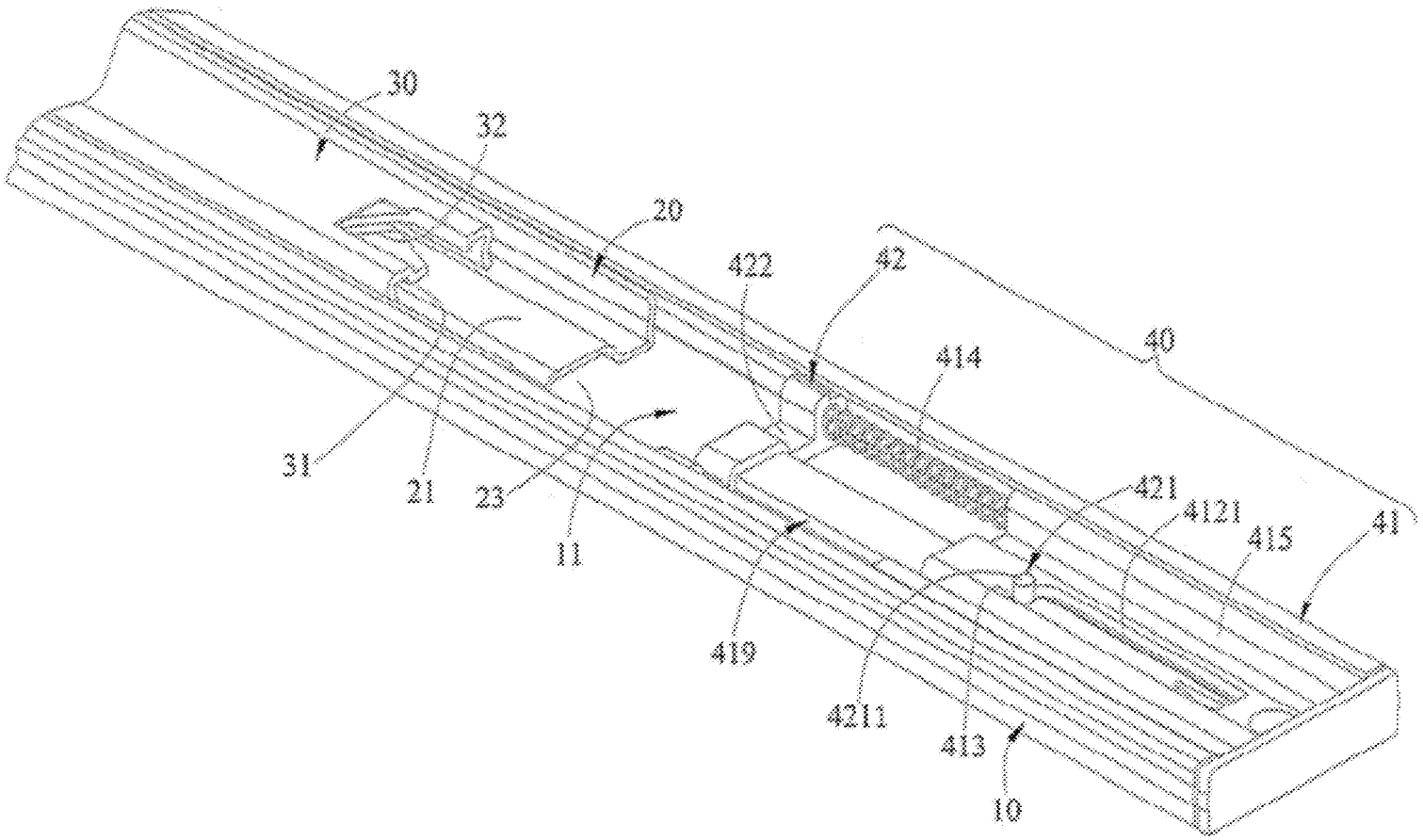
FIG. 17 is an assembled perspective view of the sixth embodiment of the rail assembly in accordance with the present invention.
Figure 18:
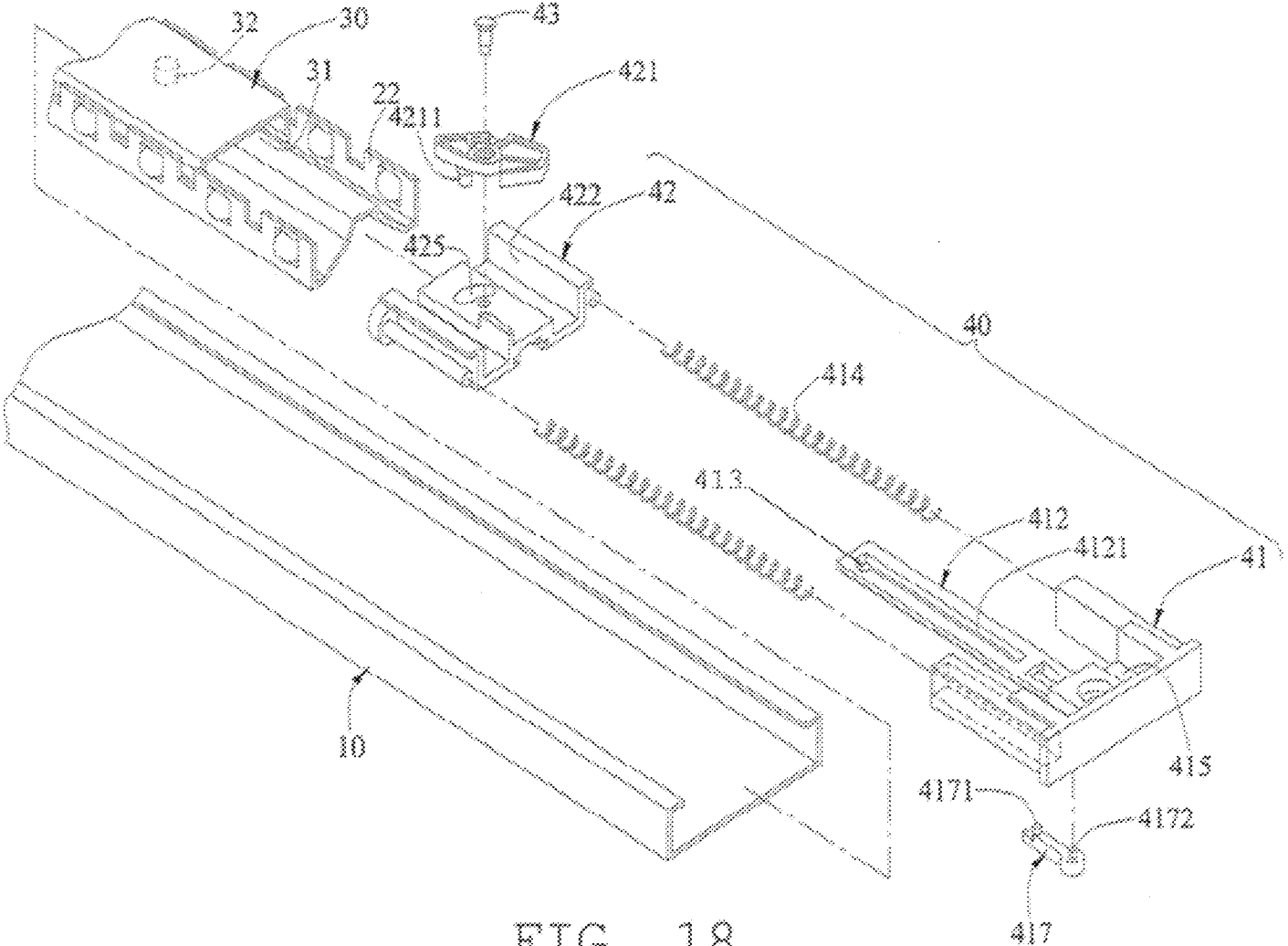
FIG. 18 is an exploded perspective view of a seventh embodiment of a rail assembly in accordance with the present invention.
Figure 19:
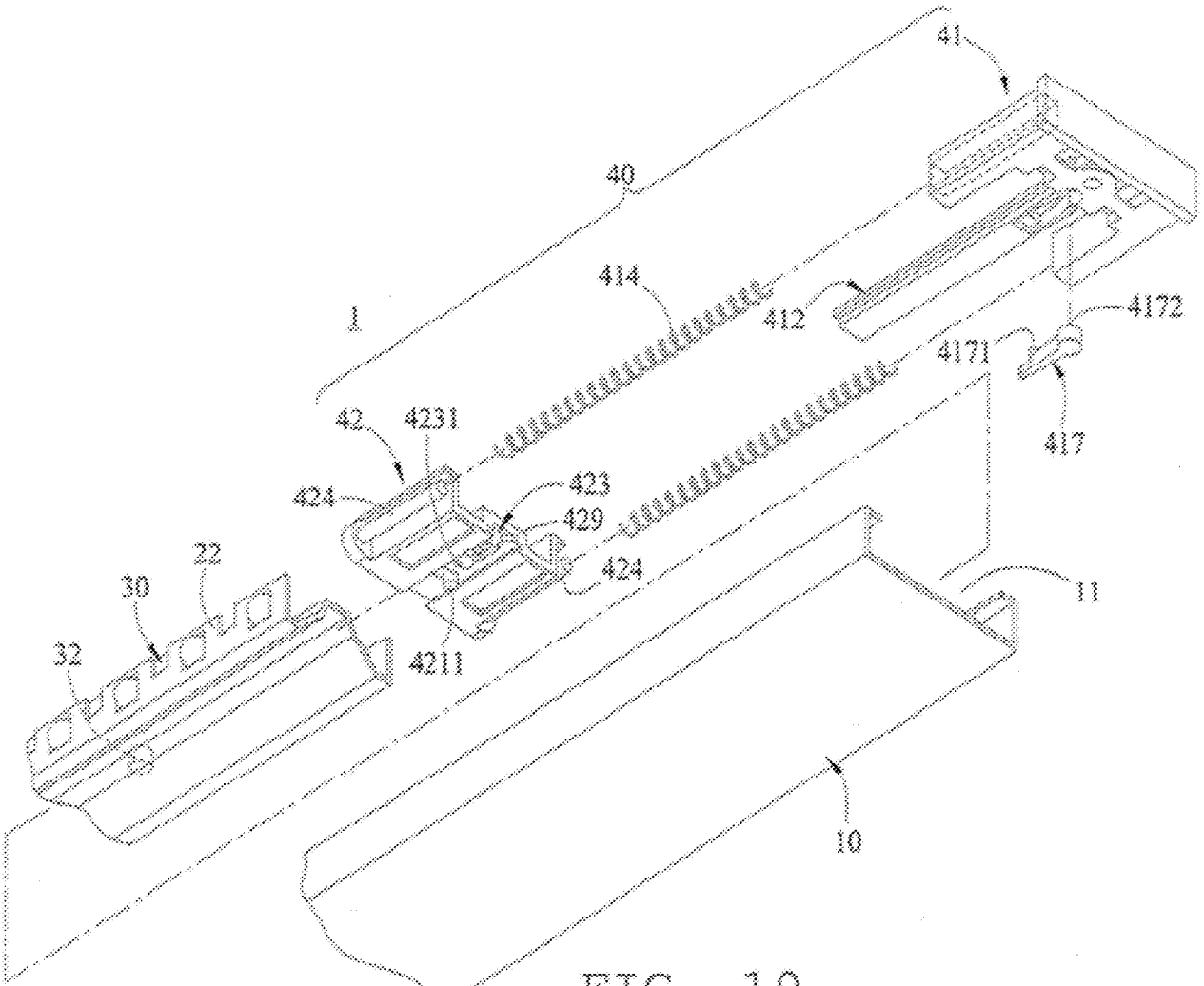
FIG. 19 is another exploded perspective view of the seventh embodiment of the rail assembly in accordance with the present invention, which is viewed from another orientation.
Figure 20:
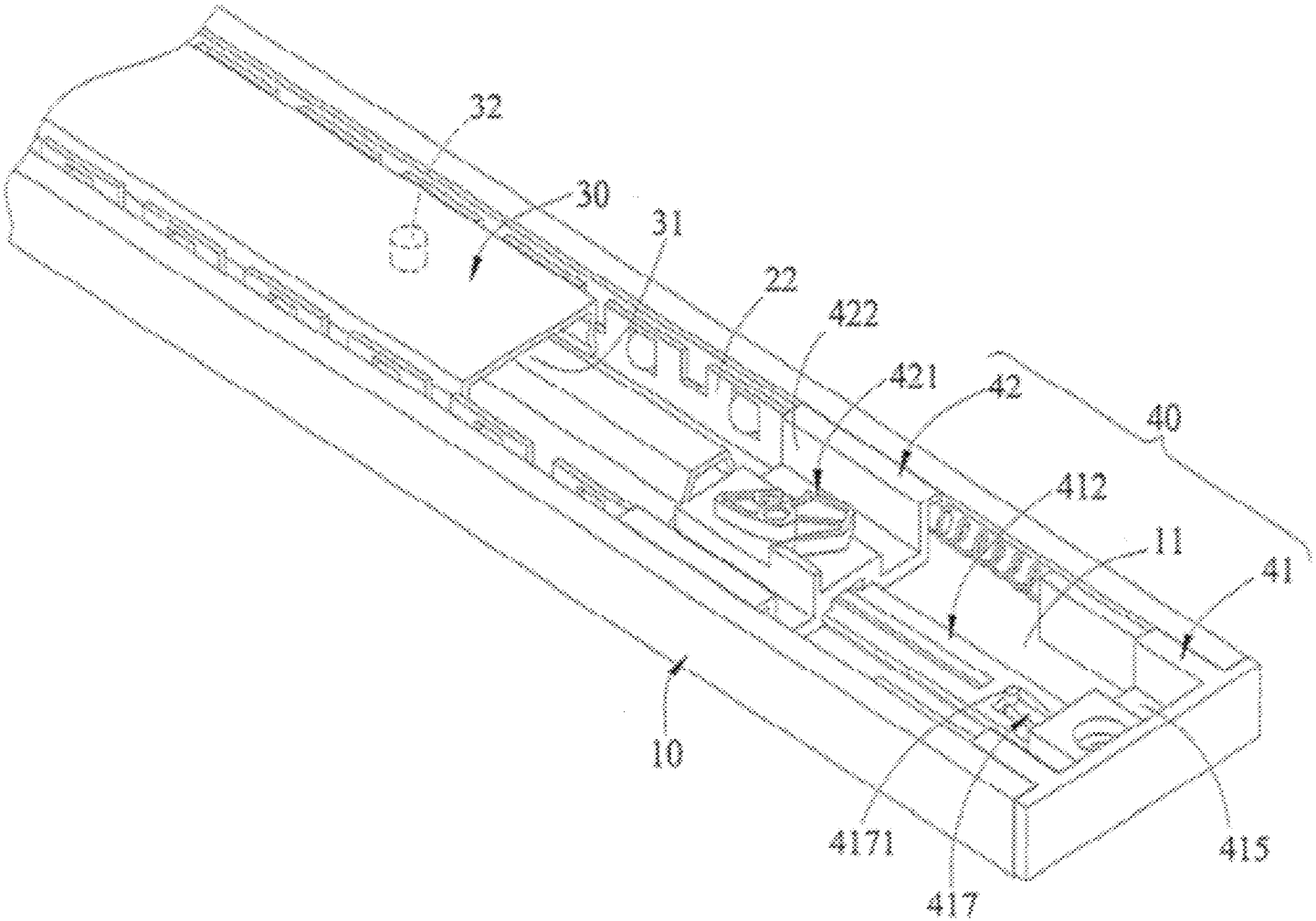
FIG. 20 is an assembled perspective view of the seventh embodiment of the rail assembly in accordance with the present invention.

Referring to FIGS. 16-17, a sixth embodiment of a rail assembly in accordance with the present invention is illustrated. The function and features, which are the same with the third embodiment are not described repeatedly. Only the differences there-between are described. In this embodiment, the retrieving unit 40 includes a fixing part 41, a moving part 42, a clip 421, and a spring 414. The fixing part 41 has a slot-type sliding rail 45 defined in an underside thereof. The moving part 42 has an extending rail 419 extended from one end thereof and corresponding to the sliding rail 45, such that the moving part 42 is enabled to slide in a free-end of the outer rail space 11. The extending rail 419 has a slot 425 defined therein for movably receiving the second (stable) projection 4212 of the clip 421. The first (clipping) projection 4211 passes the lean rail 4121 and selectively engages with the guiding member 32. When the inner rail 30 is pulled out, the guiding member 32 engages with the clip 421 to drive the clip 421 and the moving part 42 to move along the lean rail 4121. When the clip 421 slides into the hold slot 413, the first (clipping) projection 4211 engages with the hold slot 413, such that the moving part 42 is fixed on the hold slot 413 temporarily, and the inner rail 30 continuously slides outwards.

Through the structure of the open-type sliding rail 412, the moving part 42 is enabled to slide in a free-end of the outer rail space 11, so as to increase the retracting stroke of the moving part 42 and increase the sliding scope of the middle rail 20, thereby increasing the length of the middle rail 20 and the overall spread length of the rail assembly.

Referring to FIGS. 18-23, a seventh embodiment of a rail assembly in accordance with the present invention is illustrated. The function and features, which are the same with the third embodiment are not described repeatedly. Only the differences is there-between are described. In this embodiment, the retrieving unit 40 further comprises a buckling unit. The buckling unit includes a buckling member 417, which connects the moving part 42 to the fixing part 41, a limited slot 423 defined in the moving part 42, and a buckling portion 4231 formed in the limited slot 423. The buckling member 417 has a pivotal projection 4172 and a buckling projection 4171. The pivotal projection 4172 is pivoted to the fixing part 41, such that the buckling projection 4171 is rotated relative to the pivotal projection 4172. The buckling projection 4171 selectively engages with buckling portion 4231, such that the moving part 42 fixed on the buckling member 417 to limit the movement of the moving part 42 in the sliding rail 412. The springs 414 are disposed between the fixing part 41 and the moving part 42 to provide the retracting force.

Figure 23:
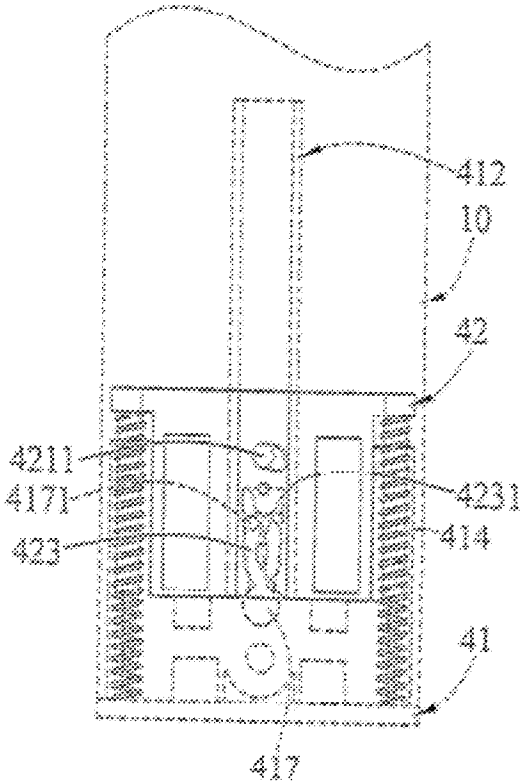
FIGS. 21-23 show the operation of the seventh embodiment of the rail assembly in accordance with the present invention.
Figure 22:
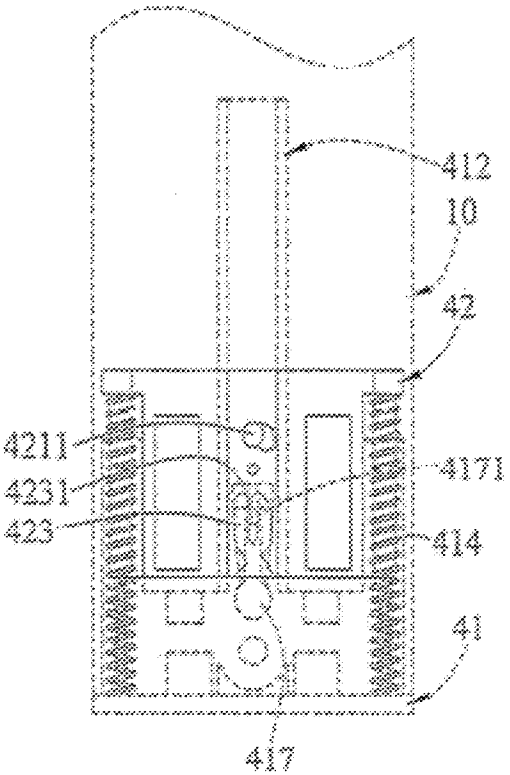
Figure 21:
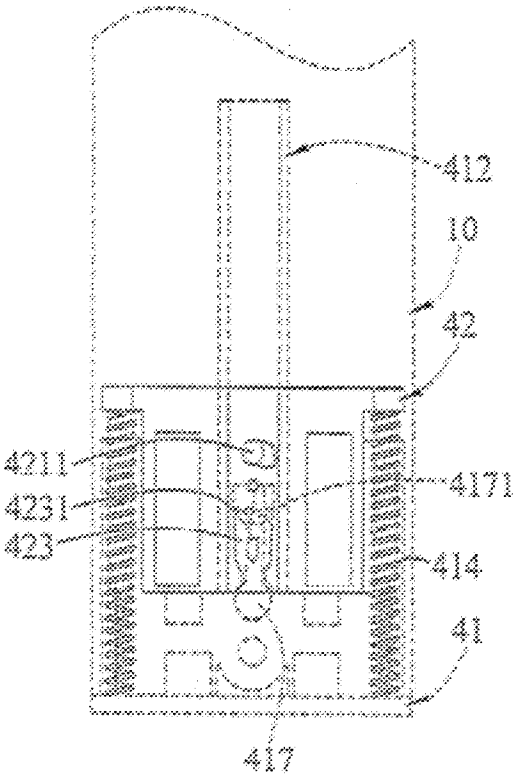

Referring to FIGS. 21-23, the operation of the rail assembly is illustrated. When an external force is applied on the inner rail 30, the inner rail 30 retracts in the outer rail space 11 and extends into the end of the outer rail 10. In this case, the guiding member 32 engages with the clip 421, so as to push the moving part 42 to compress the springs 414, such that the moving part 42 is temporarily fixed and snapped (not shown). Referring to FIG. 21, when the middle rail 20 and the inner rail 30 are extended into the end of the outer rail 10, the buckling projection 4171 of the buckling member 417 enter the limited slot 423, and the buckling projection 4171 is guided by the limited slot 423 to move the buckling portion 4231. Referring to FIG. 22, when the external force is removed, the moving part 42 is subjected the resilient force provided by the spring 414 to move toward the direction opposite to the fixing part 41. The buckling projection 4171 engages with the buckling portion 4231 to limit the movement of the moving part 42. Therefore the middle rail 20 and the inner rail 30 are stopped in the outer rail space 11. Referring to FIGS. 22-23, when user applies the external force again, the moving part 42 is made to move toward the direction of the fixing part 41. The buckling projection 4171 is guided by the limited slot 423 and disengages with the buckling portion 4231, so as to release the stopping state between the moving part 42 and the fixing part 41. The moving part 42 is subjected the resilient force provided by the spring 414. The inner rail 30 moves along the sliding rail 412, such that the inner rail 30 moves is ejected to the hold slot 413 on the lean rail 4121 along the sliding rail 412. The moving part 42 is stopped on the hold slot 413, and the inner rail 30 continuously slides outwards.

Through the structure of the open-type sliding rail 412, the moving part 42 is enabled to slide in a free-end of the outer rail space 11, so as to increase the retracting stroke of the moving part 42 and increase the sliding scope of the middle rail 20, thereby increasing the length of the middle rail 20 and the overall spread length of the rail assembly.

Although the invention has been explained in relation to its preferred embodiment, it is to be understood that many other possible modifications and variations can be made without departing from the spirit and scope of the invention as hereinafter claimed.

What is claimed is:

1. A rail assembly comprising:

an outer rail having an outer rail space defined therein for receiving a middle rail, an inner rail, and a retrieving unit;

the middle rail sliding in the outer rail space, and having a middle rail space defined therein;

the inner rail slide in the middle rail space;

the retrieving unit disposed in one end of the outer rail space, comprising:

a fixing part, disposed in the outer rail space, and close one end of the outer rail space to a closed end;

a sliding rail, disposed on one end of the fixing part, and disposed under the middle rail; the sliding rail having a guiding rail, and the guiding rail having a lean rails formed therein, the lean rails having a hold slot and a slot defined therein;

a moving part, disposed on the sliding rail, and sliding along the sliding rail and the guiding rail, and sliding in a free-end of the outer rail space; wherein when the inner rail is pushed inwardly, the middle rail extends into the outer rail space which the moving part is sliding in the sliding rail, so as to increase a sliding scope and a length of the middle rail; a guiding groove disposed at a bottom of the moving part and matched with the guiding rail;

a clip, disposed on the moving part and is rotated corresponding to the moving part, the clip having two projections and a jointer formed therein;

a guiding member, disposed on the inner rail; when wherein the inner rail is pulled outwardly, the clip slides into the hold slot, the moving part is temporarily fixed by the clip; when wherein the inner rail is pushed inwardly, the guiding member is engaged with the jointer, such that the inner rail and the moving part are connected, so as to drive the moving part to stably slide along the sliding rail;

at least one spring, disposed between the fixing part and the moving part; and two receiving slots, respectively disposed between the fixing part and the moving part with the outer rail, when wherein the inner rail slides in the outer rail space, the inner rail spans across the receiving slots and reaches the closed end of the outer rail space, and increase the overall spread length of rail assembly.

2. The rail assembly as claimed in claim 1, wherein the sliding rail is formed from the outer rail, which is in a free-end of the fixing part; the lean rail is disposed in a free-end of the fixing part and in the receiving spaces at the bottom of the middle rail, such that the moving part moves along the sliding rail in a free-end of the outer space.

3. The rail assembly as claimed in claim 1, wherein the guiding rail is disposed in a free-end of the fixing part and separated from the fixing part.

4. The rail assembly as claimed in claim 1, further comprising a damping unit, the damping unit including a damper and a corresponding mechanism for the damper to provide a damping function.

5. The rail assembly as claimed in claim 1, wherein the clip has a resilient groove; when the clip engages with the guiding member, the clip is connected to the inner rail to drive the moving part to engage/disengage with the hold slot; when the moving part drops out and automatically retracts, such that the guiding member is engaged with the clip, so as to drive the moving part to retract to a normal snapping state.

6. A rail assembly comprising:

an outer rail having an outer rail space defined therein for receiving an inner rail, and a retrieving unit;

an inner rail movably received in the outer rail space;

the retrieving unit disposed on one end of the outer rail space, comprising:

a fixing part, disposed in the outer rail space, and close one end of the outer rail space to a closed end;

a sliding rail, disposed on the fixing part, the sliding rail having a guiding rail, the guiding rail having a lean rails formed therein, the lean rails having a hold slot and a slot defined therein;

a moving part, disposed on the sliding rail, and sliding along the sliding rail, and sliding in a free-end of the outer rail space;

a clip, disposed on the moving part and being rotated corresponding to the moving part, the clip having two projections and a jointer formed therein;

a guiding member, disposed on the inner rail; when wherein the inner rail is pulled outwardly, the clip slides into the hold slot, the moving part is temporarily fixed by the clip; when wherein the inner rail is pushed inwardly, the guiding member is engaged with the jointer, such that the inner rail and the moving part are connected, so as to drive the moving part to stably slide along the sliding rail;

at least one spring, disposed between the fixing part and the moving part; and two receiving slots, respectively disposed between the fixing part and the moving part with the outer rail, when wherein the inner rail slides in the outer rail space, the inner rail spans across the receiving slots and reaches the closed end of the outer rail space, and increase the overall spread length of rail assembly.

* * * * *